US008104107B2

(12) United States Patent
Jin

(10) Patent No.: US 8,104,107 B2
(45) Date of Patent: Jan. 31, 2012

(54) NOZZLE STRUCTURE OF BIDET WITH SWIRLING WATER CURRENT

(75) Inventor: Sung-Worl Jin, Seoul (KR)

(73) Assignee: Woongjin Coway Co., Ltd., Choongcheongnam-Do (KR)

( * ) Notice: Subject to any disclaimer, the term of this patent is extended or adjusted under 35 U.S.C. 154(b) by 852 days.

(21) Appl. No.: 11/667,512

(22) PCT Filed: Mar. 23, 2005

(86) PCT No.: PCT/KR2005/000848

§ 371 (c)(1), (2), (4) Date: Aug. 24, 2007

(87) PCT Pub. No.: WO2006/052051

PCT Pub. Date: May 18, 2006

(65) Prior Publication Data

US 2008/0016609 A1 Jan. 24, 2008

(30) Foreign Application Priority Data

Nov. 9, 2004 (KR) ..... 10-2004-0090968

(51) Int. Cl.
*A61H 35/00* (2006.01)

(52) U.S. Cl. ..... 4/448; 4/447; 4/420.2; 4/420.4; 239/399; 239/423; 239/424; 239/424.5

(58) Field of Classification Search ..... 4/420.2, 4/420.4, 447, 448; 239/242, 242.5, 399, 239/423, 424, 424.5
See application file for complete search history.

(56) References Cited

U.S. PATENT DOCUMENTS

| | | | |
|---|---|---|---|
| 6,754,912 B1 | 6/2004 | Hayashi et al. | |
| 6,795,981 B2 * | 9/2004 | Sato et al. | 4/420.4 |

FOREIGN PATENT DOCUMENTS

| | | | |
|---|---|---|---|
| JP | 01-214630 | | 8/1989 |
| JP | 2001090155 | | 4/2001 |
| JP | 2003193537 | * | 7/2003 |
| JP | 2003239360 A | | 8/2003 |

* cited by examiner

OTHER PUBLICATIONS

Extended European Search Report (EESR), PCT/KR2005/000848, issued on Feb. 15, 2011, pp. 1-3.

*Primary Examiner* — Gregory Huson
*Assistant Examiner* — Lauren Heitzer
(74) *Attorney, Agent, or Firm* — Perkins Coie LLP

(57) ABSTRACT

A nozzle structure of a bidet with swirling water current is provided, in which a user controls water spraying angle of water current sprayed from an outlet of a cleaning nozzle, and the water current with swirling force is sprayed in a circular pattern without causing an eccentricity, thereby increasing cleaning power and reducing water consumption. The nozzle structure of a bidet includes a water channel unit with two internal water channels classified as a wide flow channel and a linear flow channel; a cleaning nozzle tip where water current passed through the wide flow channel and water current passed through the linear flow channel are combined and spouted, wherein the cleaning nozzle tip is connected to an end of the water channel unit; and a fluid mixing unit arranged in an upper portion of an interior of the cleaning nozzle tip such that the fluid mixing unit applies a torque to the water current flowing upward after passing through the wide flow channel and the linear flow channel so as to thereby generate swirling forces of water current. It is possible to prevent an eccentricity of water current and control the water spray angle to be maintained at a constant level, while generating swirling water current with varying swirling forces of water current spouting from the outlet of the cleaning nozzle tip. This enables a user to change his or her body parts contacting the water current even without moving his or her body, and increases in cleaning power.

4 Claims, 10 Drawing Sheets

[Fig. 1]
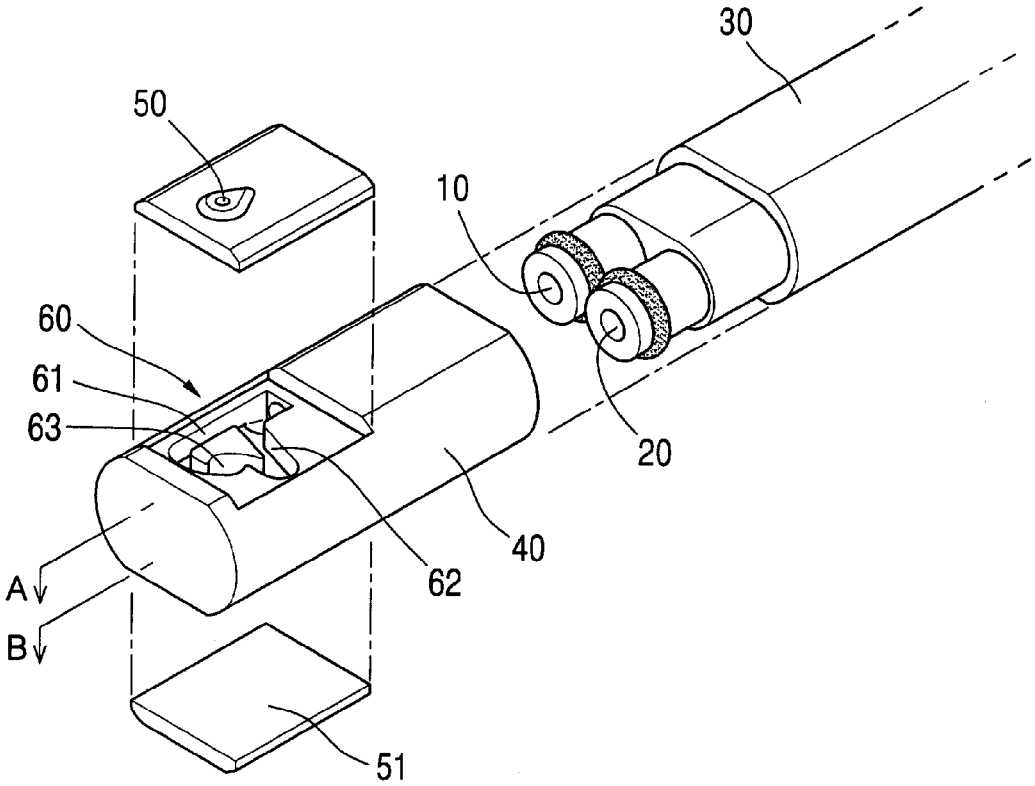
[Fig. 2]
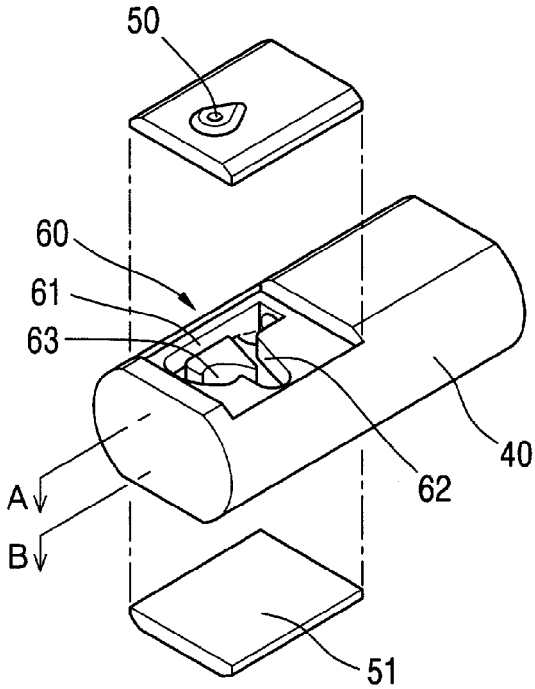

[Fig. 3]
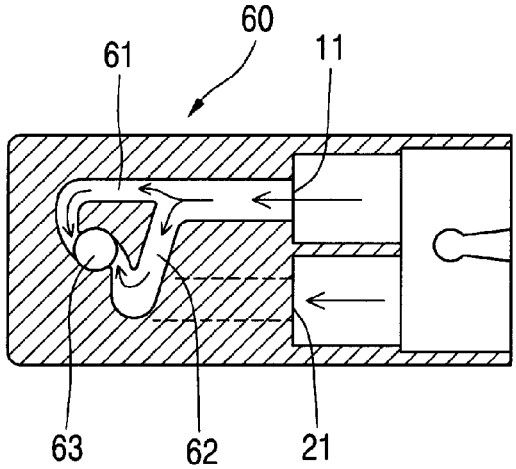
[Fig. 4]
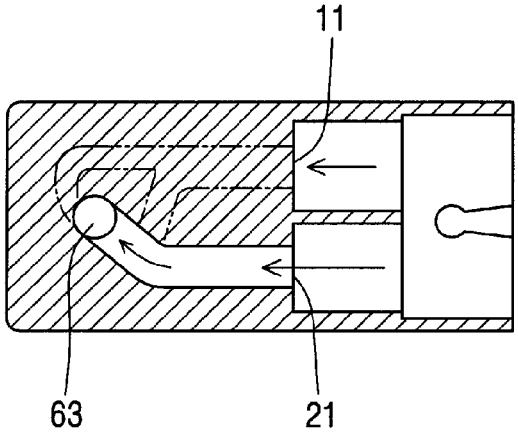
[Fig. 5]
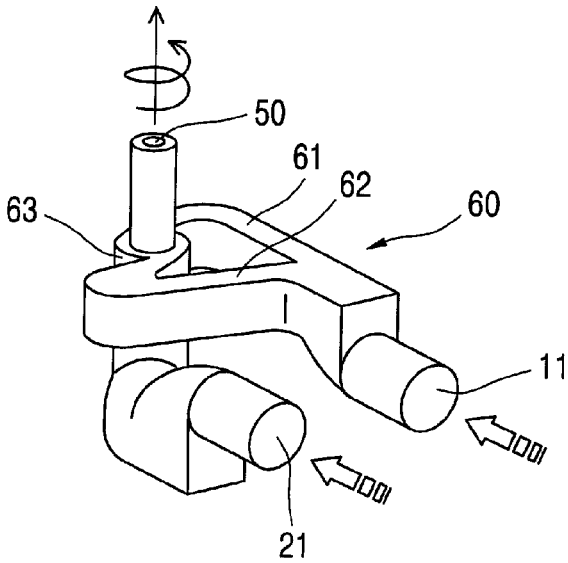

[Fig.8]
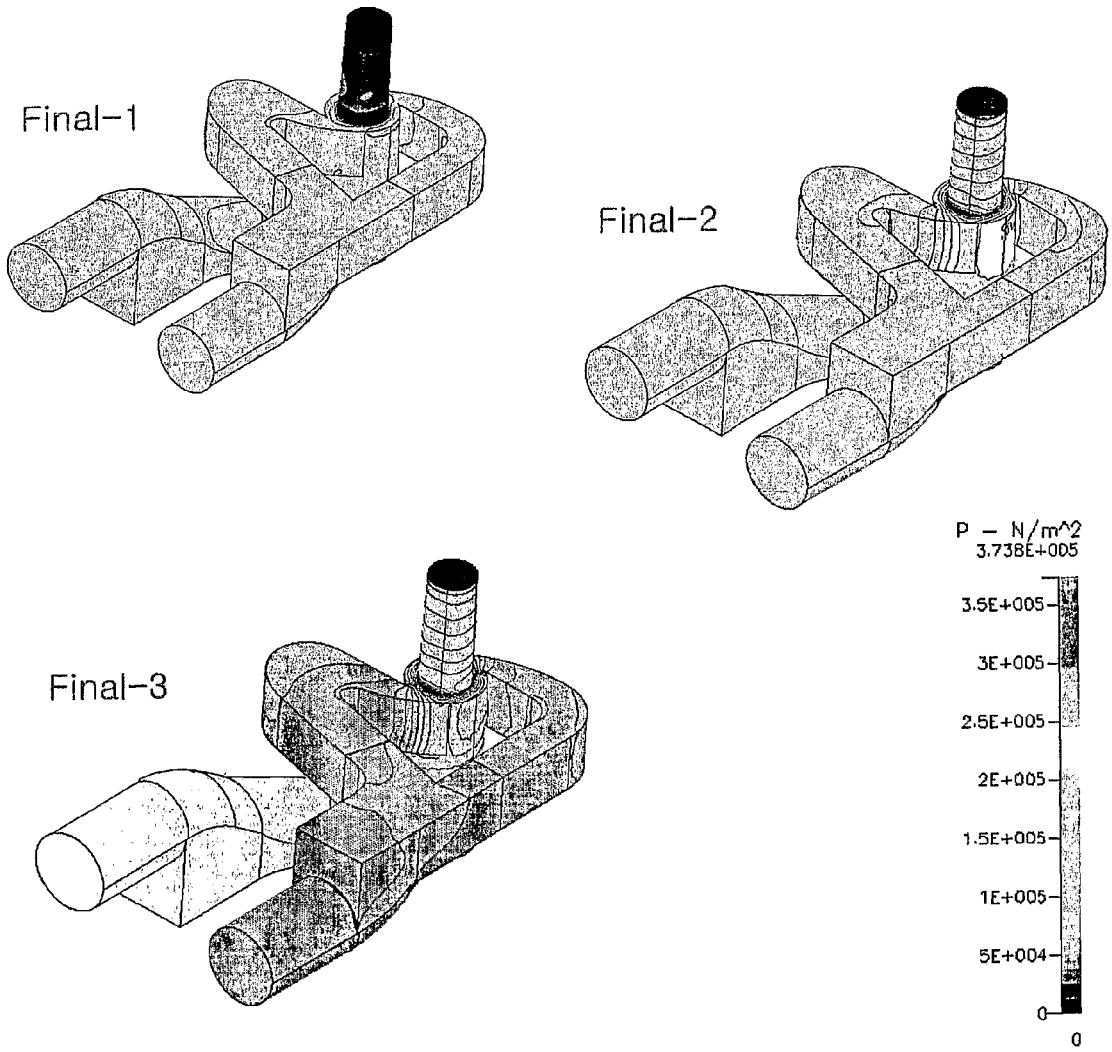

[Fig.9]
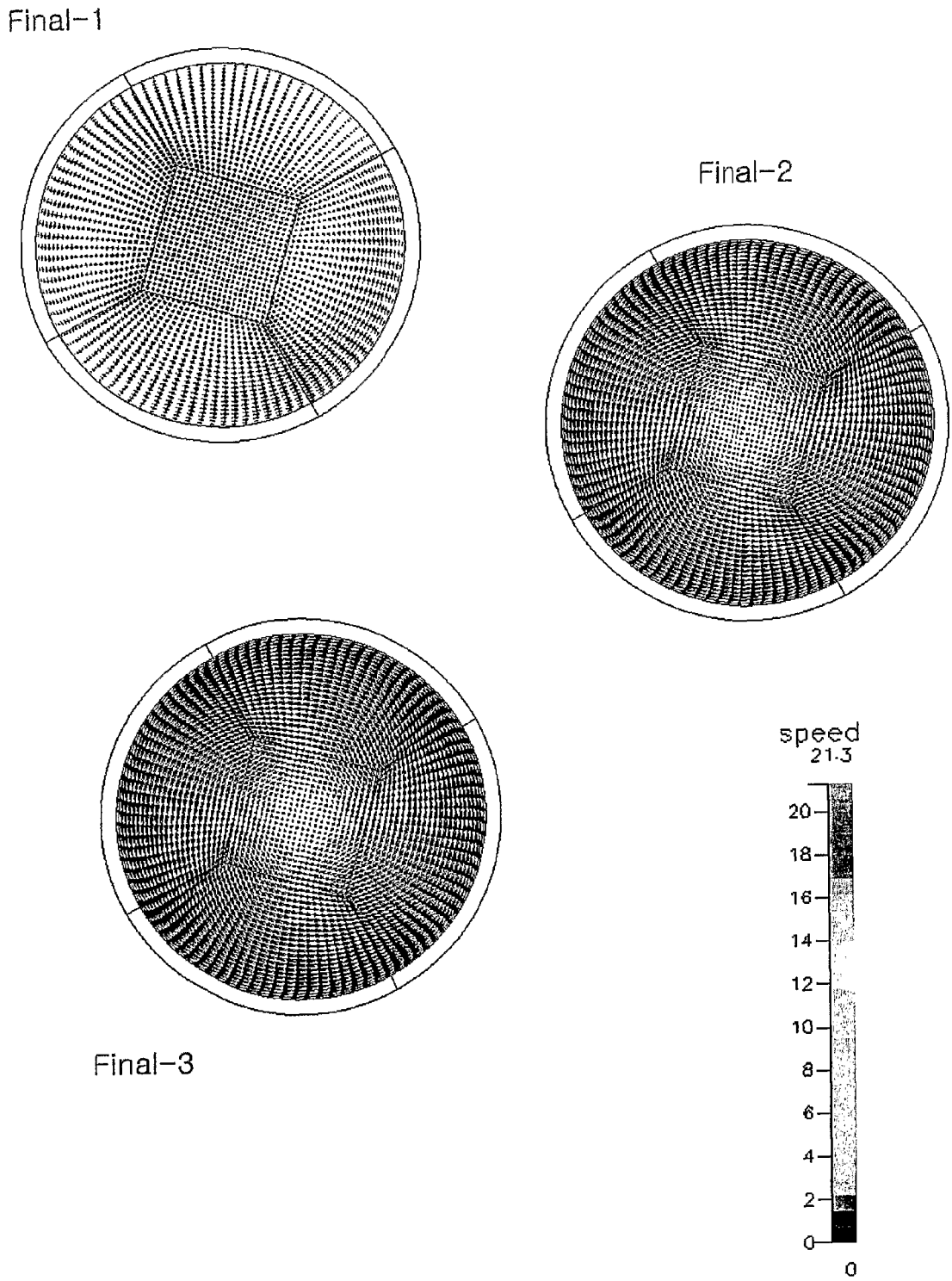

[Fig. 10]
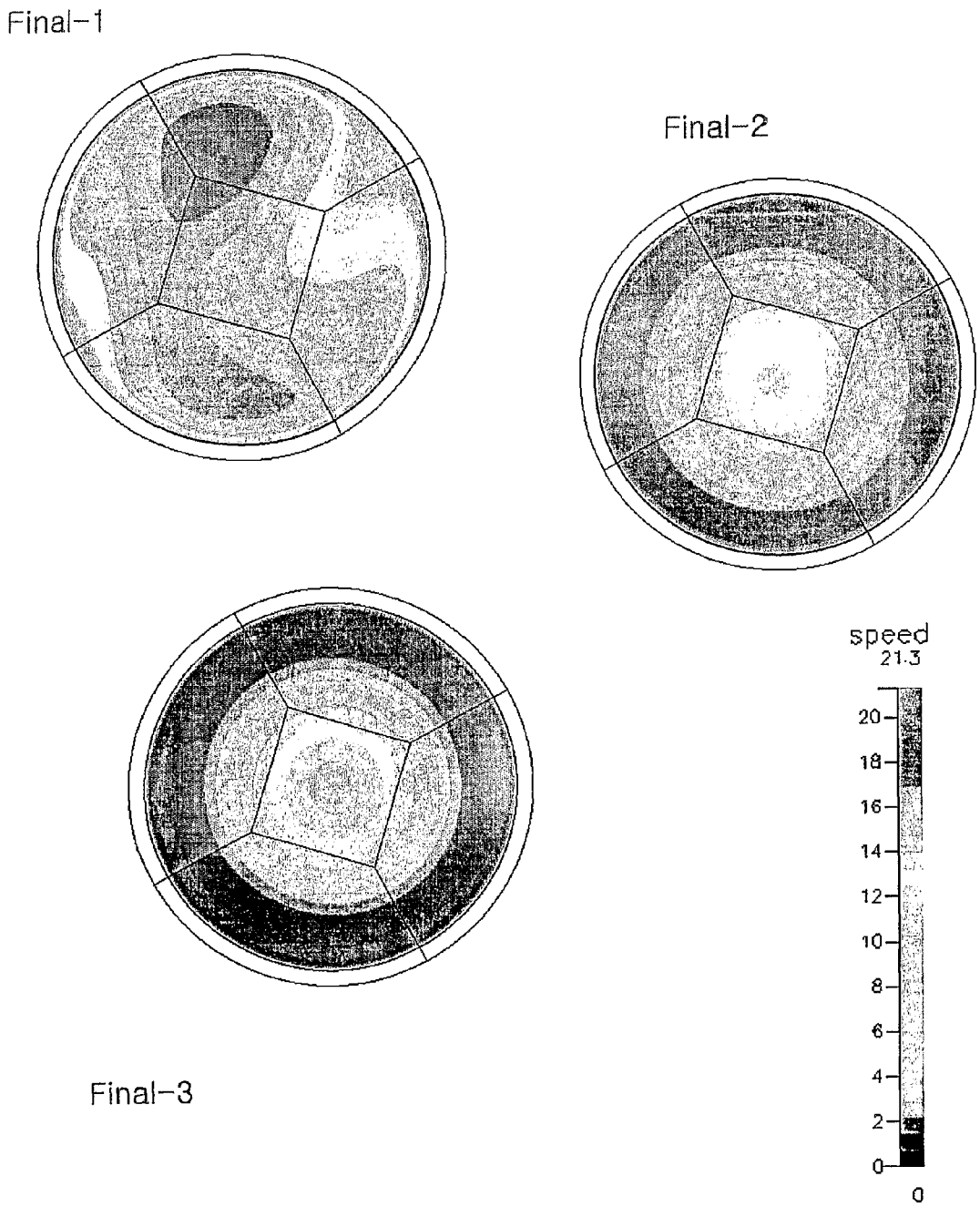

[Fig 11]
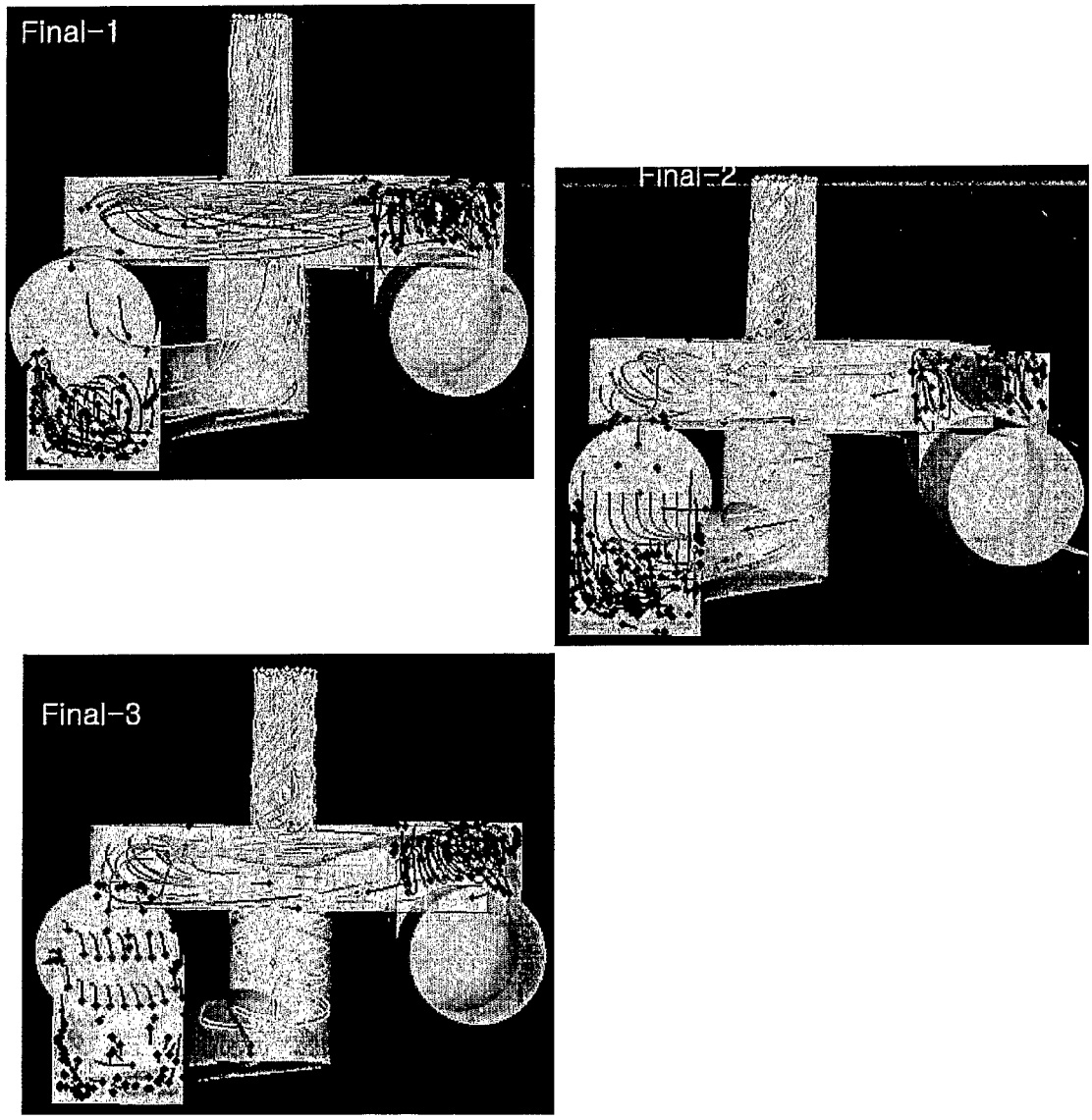

[Fig. 12]
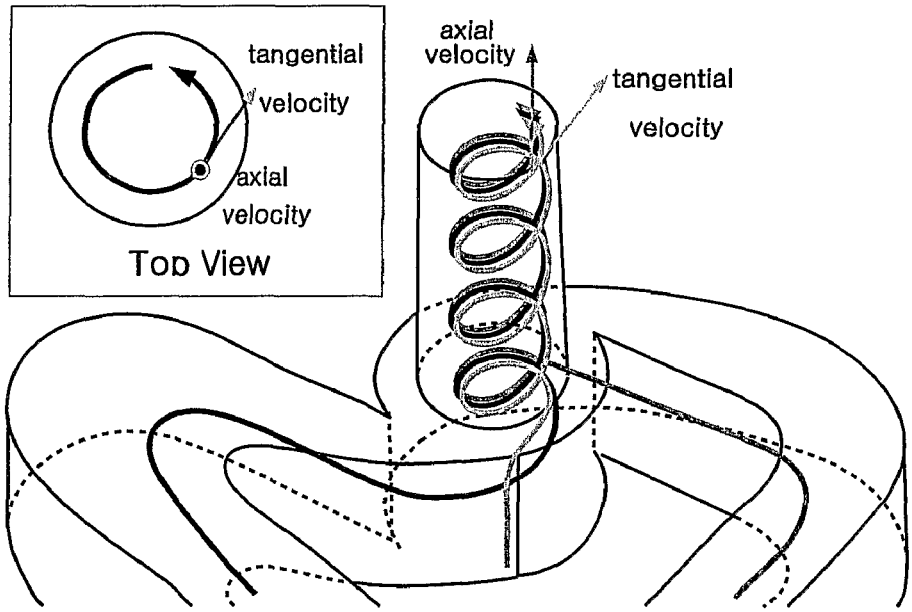

[Fig 13]
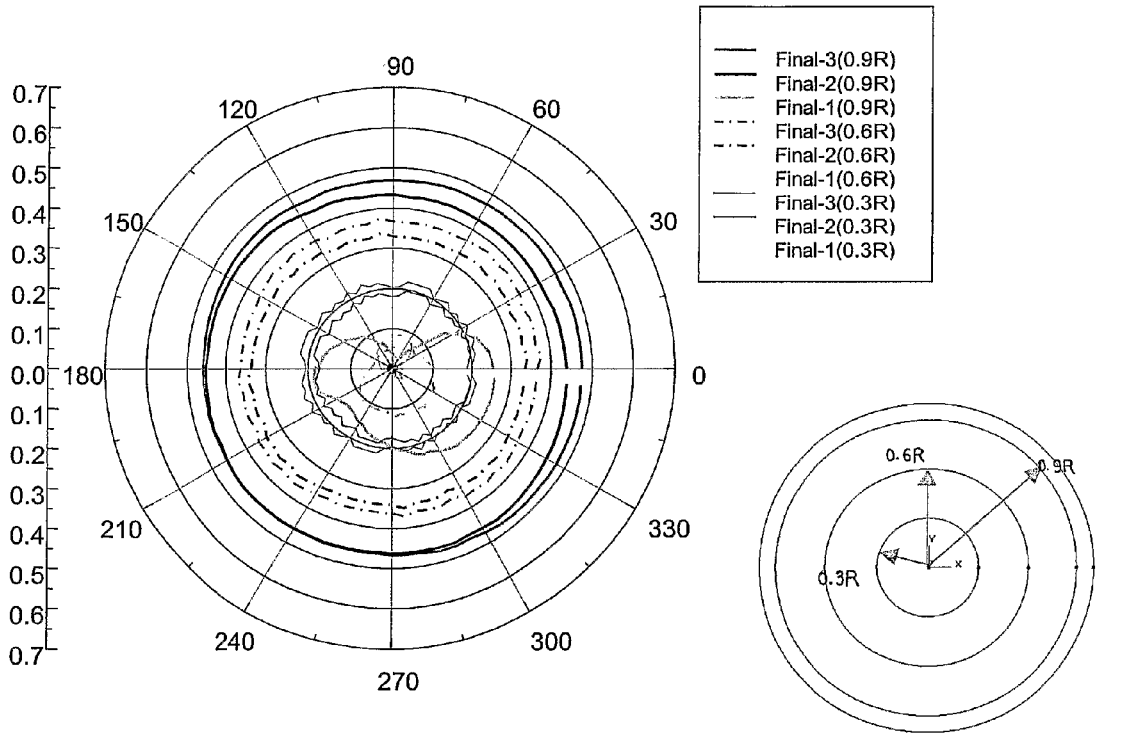
$$\text{Swirl number} = \frac{2 \times \text{tangential velocity}}{3 \times \text{axial velocity}}$$

NOZZLE STRUCTURE OF BIDET WITH SWIRLING WATER CURRENT

CROSS-REFERENCE TO RELATED APPLICATIONS

This application is a 35 USC §371 application of International Application No. PCT/KR2005/000848 filed Mar. 23, 2005, designating Korea, which claims priority to Korean Application No. 10-2004-0090968 filed Nov. 9, 2004, both of which are hereby incorporated by reference in their entirety.

TECHNICAL FIELD

The present invention relates to a cleaning nozzle of a bidet, and more particularly, to a cleaning nozzle of a bidet capable of supplying water with swirling water current.

BACKGROUND ART

In general, a bidet is assembled on a toilet seat, and filters off water supplied from a tap water supply and stores the filtered water in a water storage arranged in the body thereof. When a user presses a button for cleaning the private part of his or her body after stool, water is spouted from a nozzle by the pressure of water stored in the water storage so as to clean the genital area of an individual.

Here, water is spouted out from the nozzle at a preset water spray angle.

In a conventional bidet operating as described above, a cleaning nozzle is provided with only one water channel. This causes an eccentricity in spouting water, and difficulty in the adjustment of water spray angle from the center axis of water stream. Therefore, water spouting out from the nozzle collides against the nether body parts of a user in a narrow range. This results in user inconveniences in that the user has to move his or her body when he or she needs to change the position of body part contacting the water spouting from the nozzle. The conventional bidet also requires a large amount of water for completely cleaning of body parts to suit a user.

DISCLOSURE OF INVENTION

Technical Problem

It is an object of the present invention to provide a nozzle structure of a bidet which permits a user to control the water spray angle of water spouting from an outlet of a cleaning nozzle of the bidet, and increase cleaning power by allowing water current to have swirling forces and sprayed in a circular pattern without causing an eccentricity, while reducing water consumption.

Technical Solution

To accomplish the object of the present invention, there is provided a nozzle structure of a bidet, including a water channel unit 30 with two internal water channels classified as a wide flow channel and a linear flow channel; a cleaning nozzle tip 40 where water current passed through the wide flow channel and water current passed through the linear flow channel are combined and spouted, wherein the cleaning nozzle tip is connected to an end of the water channel unit; and a fluid mixing unit 60 arranged in an upper portion of an interior of the cleaning nozzle tip such that the fluid mixing unit applies a torque to the water current flowing upward after passing through the wide flow channel and the linear flow channel so as to thereby generate swirling forces of water current.

Advantageous Effects

The nozzle structure of a bidet of the present invention has advantages in that water currents are mixed into a symmetrical structure in the mixing portion of the fluid mixing unit so as to prevent an eccentricity of water current, while generating swirling water current with varying swirling forces of water current spouting from the outlet of the cleaning nozzle tip by controlling the quantity of water flowing into the wide flow channel and the linear flow channel of the cleaning nozzle. It is possible to control the water spray angle of the water current spouting from the outlet of the cleaning nozzle tip to be maintained at a constant level. This enables a user to change his or her body parts contacting the water current even without moving his or her body, and increases in cleaning power.

BRIEF DESCRIPTION OF THE DRAWINGS

FIG. 1 is a perspective view of a cleaning nozzle of a bidet including a water channel unit with two internal water channels classified as a wide flow channel and a linear flow channel, and a cleaning nozzle tip;

FIG. 2 is a perspective view of the cleaning nozzle tip connected to the water channel unit;

FIG. 3 is a cross section view of part A of the cleaning nozzle tip shown in FIG. 2;

FIG. 4 is a cross section view of part B of the cleaning nozzle tip shown in FIG. 2;

FIG. 5 is a perspective view of the fluid mixing unit arranged in the cleaning nozzle tip;

FIG. 8 shows distribution of pressure in flow channels of the fluid mixing unit for each case in accordance with the result of data analysis experiment;

FIG. 9 shows distribution of water current vector at an outlet of the cleaning nozzle tip in accordance with the result of data analysis experiment;

FIG. 10 shows distribution of flux at an outlet of the cleaning nozzle tip in accordance with the result of data analysis experiment;

FIG. 11 is a three-dimensional fluid flow diagram drawn on the basis of fluid analysis data for the swirling force generated by the water current passed through the wide flow channel and the linear flow channel and mixed in the fluid mixing unit;

FIG. 12 is a diagram showing the speed component at the outlet of the cleaning nozzle tip; and FIG. 13 shows distribution of swirling water current at the outlet of the cleaning nozzle tip in accordance with the result of data analysis experiment.

MODE FOR THE INVENTION

Figure 6:
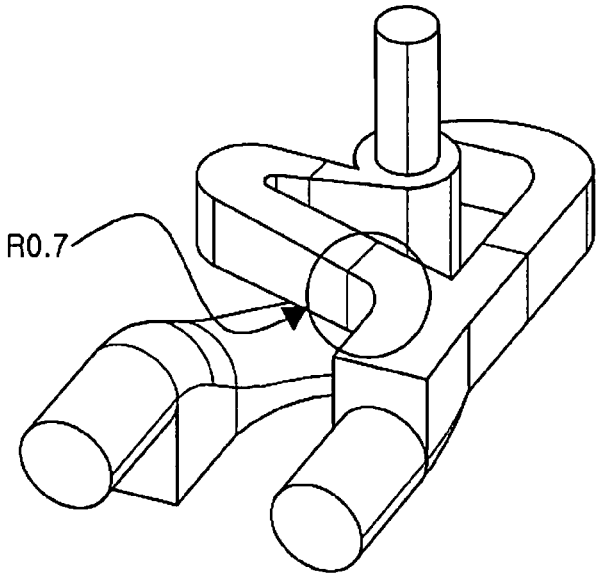
FIG. 6 is an isometric view of the fluid mixing unit.

A nozzle structure of the present invention will be explained in detail, with reference to the attached drawings.

FIG. 1 is a perspective view of a cleaning nozzle of a bidet including a water channel unit with two internal water channels classified as a wide flow channel and a linear flow channel, and a cleaning nozzle tip, FIG. 2 is a perspective view of the cleaning nozzle tip connected to the water channel unit, and FIG. 5 is a perspective view of the fluid mixing unit arranged in the cleaning nozzle tip.

A fluid mixing unit 60 is arranged in an upper portion of an interior of a cleaning nozzle tip 40 and connected to an end of a wide flow channel 10. A flow channel is formed in a lower portion of the cleaning nozzle tip and connected to an end of a linear flow channel 20. The flow channel is also connected to an outlet 50 of the cleaning nozzle tip 40. The upper portion and the lower portion of an interior of the cleaning nozzle tip 40 are interconnected only through a mixing portion 64 of the fluid mixing unit 60.

The fluid mixing unit 60 has a first branch 61 and a second branch 62 where the end of the wide flow channel is divided and connected again. The fluid mixing unit 60 further has a mixing portion 63 where two water currents passed through the first branch 61 and the second branch 62 are mixed in a symmetrical structure. The mixing portion 63 is perpendicularly connected to the outlet 50 of the cleaning nozzle tip 40 connected to the end of the linear flow channel 20.

The cleaning nozzle of the present invention includes an anus cleaning nozzle and a local body part cleaning nozzle, and more desirably, an anus cleaning nozzle.

The cleaning nozzle of the present invention operates as follows.

A water quantity control valve is arranged at a rear end of the water channel unit 30 in such a manner that the valve freely controls mixing ratio of water flowing into the wide flow channel and the linear flow channel. The water quantity control valve first supplies water to the linear flow channel 20, and decreases the quantity of water flowing into the linear flow channel 20 and simultaneously increases the quantity of water flowing into the wide flow channel 10.

The water current flowing into the linear flow channel 20 flows downward through a flow channel 21 led into the lower portion of the interior of the cleaning nozzle tip 40, and subsequently flows upward to cross the fluid mixing unit 60.

A water current 11 flowing into the upper portion of the cleaning nozzle tip 40 from an end of the wide flow channel 10 is divided into two streams when flowed into two branches 61 and 62 of the fluid mixing unit 60. The branched water currents are combined into a symmetrical structure in the mixing portion 63. A water current 21 flowing from the linear flow channel 20 flows upward after passing through the lower portion of the cleaning nozzle tip. The water current 21 is applied with a torque, to thereby generate water current having swirling forces. The water current with swirling forces is spouted through the outlet 50 of the cleaning nozzle tip 40 which has a single outlet hole. Here, the size of the torque varies by controlling the quantity of water flowing into the wide flow channel 10 and the linear flow channel 20, to thereby control a water spray angle of the swirling water current.

The water current flowing through the respective branches 61 and 62 of the fluid mixing unit has a symmetrical structure, which permits the torque being applied to the water current 21 flowing upward to have a symmetrical structure. This prevents eccentricity of the water current 21 which flows upward and spouts, while generating concentrical forces, to thereby allow swirling water current to have a circular cross section.

Hereinafter, result of experiment on the operation of the nozzle of the present invention will be explained.

FIG. 6 is an isometric view of the fluid mixing unit used in the analysis of experimental data. As shown in FIG. 6, the second branch 62 of the fluid mixing unit 60 is curved to have a radius of curvature 0.7 mm so as to reduce a flow difference between the first branch 61 and the second branch 62. Table 1 shows the type and counts of grids used in the experiment.

TABLE 1

| Grid type | Counts |
|---|---|
| Tetrahedral grid | 1,964,635 |
| Pyramid grid | 2,880 |
| Hexahedral grid | 213,120 |
| Total | 2,180,635 |

The fluid used in the analysis is water having physical properties, as follows.

Density=997 (kg/m3)

Viscosity=0.000855 (kg/m·sec)

Figure 7:
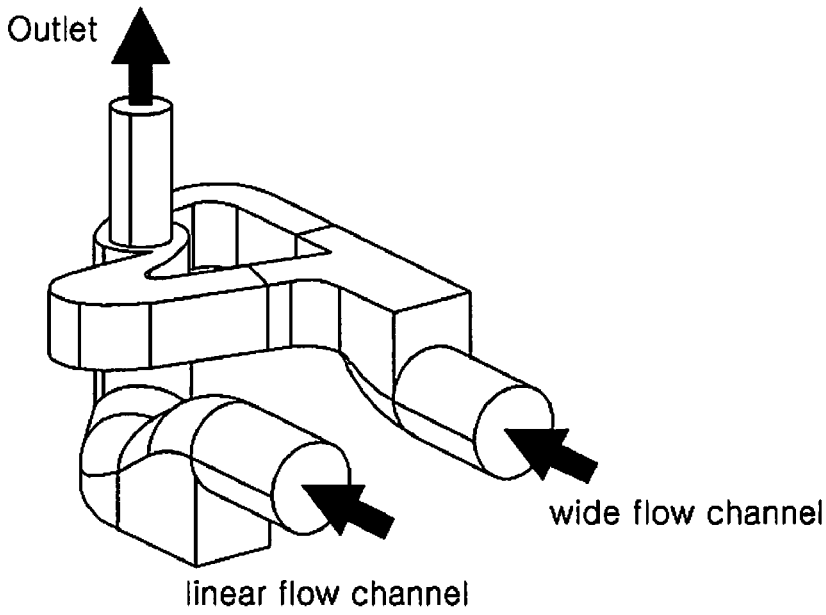
FIG. 7 is a perspective view of the final structure of the fluid mixing unit where data analysis is performed.

The fluid mixing unit used in the data analysis has a configuration shown in FIG. 7. The outlet of the nozzle tip has a fixed pressure condition of 1 pressure. Table 2 shows conditions of the inlet for each final case, and experiment is performed by varying flow rate in each flow channel so as to calculate a difference between a linear water channel and a swirling water current.

TABLE 2

| | Final case-1 | | Final case-2 | | Final case-3 | |
|---|---|---|---|---|---|---|
| | linear flow channel | wide flow channel | linear flow channel | wide flow channel | linear flow channel | wide flow channel |
| cross section area($m^2$) | 3.14159E−06 | 3.14159E−06 | 3.14159E−06 | 3.14159E−06 | 3.14159E−06 | 3.14159E−06 |
| quantity of water flowing per minute(ml/min) | 580 | 400 | 250 | 700 | 150 | 800 |
| quantity of water flowing per second($m^2$/sec) | 9.66667E−06 | 6.66667E−06 | 4.16667E−06 | 1.16667E−05 | 0.0000025 | 1.33333E−05 |
| flux(m/sec) | 3.0770 | 2.1221 | 1.3263 | 3.7136 | 0.7958 | 4.2441 |
| K(water flow kinetic energy(kg/$m^2$sec$^2$)) | 0.0057 | 0.0027 | 0.0011 | 0.0083 | 0.0004 | 0.0108 |
| D(Dissipation: degree of distribution of water flow kinetic energy at inner wall of flow channel) | 0.0879 | 0.0288 | 0.0070 | 0.1546 | 0.0015 | 0.2308 |

FIG. 8 shows distribution of pressure in flow channels of the fluid mixing unit for each case in accordance with the result of data analysis experiment. The mean value of channel pressure level in the fluid mixing unit is lower than the pressure level in the final case-3, because the flow resistance decreases by the improvement of channel structure at the second branch 62 which branches off water current at an end of the wide flow channel 10.

In Table 3, difference of flow rate at the first and second branches 61, 52 is smaller in final cases-1 and 2 than in the final case-3.

TABLE 3

| | quantity of water flowing to left side, branch 62(Kg/sec) | quantity of water flowing to right side, branch 61(Kg/sec) | quantity of water of left sidevs quantity of water of right side |
|---|---|---|---|
| final case-1 | 3.31E−03 | 3.33E−03 | 1:1.01 |
| final case-2 | 5.56E−03 | 6.05E−03 | 1:1.09 |
| final case-3 | 6.32E−03 | 6.94E−03 | 1:1.10 |

In Table 4, swirl number on the identical radial line of the cleaning nozzle tip shows uniformity in distribution and flow velocity and swirl number at an end of the cleaning nozzle tip are decreased, wherein the swirl number which indicates the distribution uniformity of swirling water current in a flow channel, is calculated by the formula (2×(Tangential Velocity))÷(3×(Axial Velocity)). In the final case-3, swirl number on the identical radial line of the cleaning nozzle tip shows the highest uniformity in distribution. FIG. 13 is a graphical representation of Table 4.

TABLE 4

| | | mean value of swirl number | standard deviation |
|---|---|---|---|
| final case-1 | 0.9R; (radius from nozzle tip center axis) × 0.9 | 0.15801 | 0.07478 |
| final case-1 | 0.6R; (radius from nozzle tip center axis) × 0.6 | 0.08086 | 0.02837 |
| final case-1 | 0.3R; (radius from nozzle tip center axis) × 0.3 | 0.03617 | 0.02613 |
| final case-2 | 0.9R | 0.44615 | 0.01216 |
| final case-2 | 0.6R | 0.33655 | 0.00541 |
| final case-2 | 0.3R | 0.18579 | 0.00799 |
| final case-3 | 0.9R | 0.46791 | 0.0067 |
| final case-3 | 0.6R | 0.36551 | 0.00465 |
| final case-3 | 0.3R | 0.20886 | 0.00723 |

The velocity of fluid in the swirling water is constituted by an axial velocity and a tangential velocity components as shown in FIG. 12. The axial velocity component of the water current passed through the outlet 50 of the cleaning nozzle tip 40 serves to permit the water current to flow in parallel with water channel axis, and the tangential velocity component of the water current produces a swirling velocity component in water current so as to spray water current in a radial direction. Accordingly, the water current spouts intensively and further as the axial velocity component increases, and spouts over a wide range and swirls as the tangential velocity component increases.

The shape of the water current spouting from the nozzle, can be estimated by calculating a free surface through the use of numerical analysis method including volume of fluids. However, the estimation requires a significant consumption of time, since the estimation requires a calculation of transient. In the experiment performed for the present invention, the estimation range is defined to an end of a nozzle so as to estimate a flow pattern. As shown in experimental data described above, tangential velocity component increases at the outlet 50 of the cleaning nozzle tip 40 as the flow rate of swirling water current increases. The tangential velocity component serves to permit the water current passed through the nozzle to swirl and is sprayed in a radial direction. Those velocity components are compared in a quantitative manner by using a variable of swirl number. Water current having higher swirling force can be obtained as the swirl number increases.

The above-described experiment leads to the conclusion, as follows.

a) in case where an additional flow channel (wide flow channel 10) is arranged and an end of the additional flow channel is symmetrically branched, rather than in case where a single flow channel is used;

i) swirling pattern with improved uniformity can be obtained on an identical radius of the cleaning nozzle tip. However, when the wide flow channel 10 is branched off, flux decreases due to increase in the cross section area of the flow channel. As a consequence, velocity and swirling intensity decreases in the cleaning nozzle tip.

ii) mean average in the wide flow channel 10 decreases, and load of pumping system is reduced. In addition, the phenomenon where the swirling current flows backward from the mixing portion 63 to the linear flow channel 50 is prevented.

b) In the final case-2, even through difference of flow rate between the first branch 61 and the second branch 62 exists, the cleaning nozzle tip may have a uniform swirling intensity distribution through the change of shape of flow channel and control of flow resistance.

c) uniformity of swirling intensity on an identical radius of the cleaning nozzle tip is improved as the difference of flow rate between the first branch 61 and the second branch 62 decreases.

d) nozzle system structure having a uniform swirling intensity distribution on an identical radius from the axial center of the outlet 50 of the cleaning nozzle tip 50 can be obtained.

e) difference in swirling intensities in accordance with the distance from the axial center of the outlet 50 of the cleaning nozzle tip 50 makes some trouble in a sensitivity test. The difference in swirling intensities is reduced by varying the length of the cleaning nozzle tip.

As described above, the nozzle structure of a bidet of the present invention has advantages in that water currents are mixed into a symmetrical structure in the mixing portion of the fluid mixing unit so as to prevent an eccentricity of water current, while generating swirling water current with varying swirling forces of water current spouting from the outlet of the cleaning nozzle tip by controlling the quantity of water flowing into the wide flow channel and the linear flow channel of the cleaning nozzle. It is possible to control the water spray angle of the water current spouting from the outlet of the cleaning nozzle tip to be maintained at a constant level. This enables a user to change his or her body parts contacting the water current even without moving his or her body, and increases in cleaning power.

INDUSTRIAL APPLICABILITY

As described above, the nozzle structure of a bidet of the present invention has advantages in that water currents are mixed into a symmetrical structure in the mixing portion of the fluid mixing unit so as to prevent an eccentricity of water current, while generating swirling water current with varying swirling forces of water current spouting from the outlet of the cleaning nozzle tip by controlling the quantity of water flowing into the wide flow channel and the linear flow channel of the cleaning nozzle. It is possible to control the water spray angle of the water current spouting from the outlet of the cleaning nozzle tip to be maintained at a constant level. This enables a user to change his or her body parts contacting the water current even without moving his or her body, and increases in cleaning power.

It is claimed:

1. A nozzle structure of a bidet with swirling water current comprising:

a water channel unit with two internal water channels classified as a wide flow channel and a linear flow channel;

a cleaning nozzle tip where water current passed through said wide flow channel and water current passed through said linear flow channel are combined and spouted, wherein said cleaning nozzle tip is connected to an end of said water channel unit; and a fluid mixing unit arranged in an upper portion of an interior of said cleaning nozzle tip such that said fluid mixing unit applies a torque to the water current flowing upward after passing through said wide flow channel and said linear flow channel so as to thereby generate swirling forces of water current;

wherein said fluid mixing unit has a first branch and a second branch where water current flowing from an end of said wide flow channel is symmetrically branched off, and the first branch and the second branch are re-connected in a mixing portion of the fluid mixing unit, wherein the mixed water currents have respective tangential velocity components relative to a central axis of the cleaning nozzle tip, wherein quantities of water passed through the first branch and the second branch are substantially equal, and all water passed through the first branch is symmetrically mixed with all water passed through the second branch in the mixing portion, and all of two water currents divided from the wide flow channel meets with a water current rising via the linear flow channel, and further wherein the water passed through the first branch and the second branch applies substantially the same torque as the vertically rising water current so as to prevent eccentricity in the water currents, and the mixing portion of the fluid mixing unit is perpendicularly connected to an outlet located in the upper portion of the cleaning nozzle tip connected to a terminal of the linear flow channel.

2. A nozzle structure of a bidet with swirling water current according to claim 1, wherein said cleaning nozzle tip has said fluid mixing unit arranged in an upper portion of an interior of said cleaning nozzle tip and connected to an end of said wide flow channel, a flow channel arranged in a lower portion of an interior of said cleaning nozzle tip such that said flow channel is connected to an end of said linear flow channel and connected to an outlet of said cleaning nozzle tip, wherein said upper portion and lower portion of the interior of said cleaning nozzle tip are connected only through the mixing portion of said fluid mixing unit.

3. A nozzle structure of a bidet with swirling water current according to claim 1, wherein:

a concentric force is applied to the water current by the fluid mixing unit so that the swirling water current has a circular cross section.

4. A nozzle structure of a bidet with swirling water current according to claim 2, wherein:

a concentric force is applied to the water current by the fluid mixing unit so that the swirling water current has a circular cross section.

* * * * *